US008768220B2

(12) United States Patent
Yoshii et al.

(10) Patent No.: US 8,768,220 B2
(45) Date of Patent: Jul. 1, 2014

(54) IMAGE FORMING APPARATUS HAVING ROTATABLE MEMBER DRIVE MECHANISM IN TONER CASE

(75) Inventors: Tatsuhiko Yoshii, Osaka (JP); Koji Murata, Osaka (JP); Naoki Mizutani, Osaka (JP); Takeshi Fujimura, Osaka (JP); Naoki Yamane, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 239 days.

(21) Appl. No.: 13/427,464

(22) Filed: Mar. 22, 2012

(65) Prior Publication Data

US 2012/0243914 A1 Sep. 27, 2012

(30) Foreign Application Priority Data

Mar. 24, 2011 (JP) ..... 2011-066040

(51) Int. Cl.
*G03G 15/08* (2006.01)

(52) U.S. Cl.
USPC ..... 399/255; 399/260; 399/263

(58) Field of Classification Search
CPC ..... G03G 15/0822; G03G 15/0839; G03G 15/0877; G03G 15/0879; G03G 15/0887; G03G 15/0889; G03G 15/0891; G03G 15/0893; G03G 2215/0802; G03G 2215/0838; G03G 2215/085
USPC ..... 399/254, 255, 256, 258, 260, 262, 263
See application file for complete search history.

(56) References Cited

U.S. PATENT DOCUMENTS

| | | | | |
|---|---|---|---|---|
| 5,784,669 | A * | 7/1998 | Miura et al. | 399/58 |
| 7,110,707 | B2 * | 9/2006 | Nishitani | 399/258 |
| 7,139,516 | B2 * | 11/2006 | Makino | 399/258 |
| 7,447,460 | B2 * | 11/2008 | Tsuchihashi et al. | 399/88 |
| 8,055,161 | B2 * | 11/2011 | Kim | 399/254 |
| 8,351,827 | B2 * | 1/2013 | Yoshii | 399/254 |
| 2006/0083553 | A1 | 4/2006 | Makino | |

FOREIGN PATENT DOCUMENTS

| | | |
|---|---|---|
| JP | 60-145138 | 9/1985 |
| JP | 10-254228 | 9/1998 |
| JP | 11-160985 | 6/1999 |
| JP | 2000-267419 | 9/2000 |
| JP | 2010-276955 | 12/2010 |

OTHER PUBLICATIONS

European Search Report, Appl. No. 12161203.0-2216 mailing date Jul. 4, 2012—6 pages.

* cited by examiner

*Primary Examiner* — Robert Beatty
(74) *Attorney, Agent, or Firm* — K&L Gates LLP

(57) ABSTRACT

A toner case includes a main body that contains toner, a discharge port located in the main body through which toner is discharged, an agitating unit rotatably positioned in the main body for agitating the toner, a transportation unit rotatably positioned in the main body for transporting the toner toward the discharge port, and a driving unit that drives the transportation unit and the agitating unit. The driving unit is rotatable forward and backward. When the driving unit rotates in one rotation direction, the agitating unit and the transportation unit rotate. When the driving unit rotates in the other rotation direction, the transportation unit does not rotate and the agitating unit rotates in the same direction as a direction in which the agitating unit rotates when the driving unit rotates in the one rotation direction.

15 Claims, 9 Drawing Sheets

IMAGE FORMING APPARATUS HAVING ROTATABLE MEMBER DRIVE MECHANISM IN TONER CASE

INCORPORATION BY REFERENCE

This application is based upon and claims the benefit of priority from the corresponding Japanese Patent application No. 2011-066040, filed Mar. 24, 2011, the entire contents of which is incorporated herein by reference.

BACKGROUND

The present disclosure relates to a toner case that contains toner, an image forming apparatus equipped with the toner case, and a method of driving a toner case.

Today, in electrophotographic image forming apparatuses, toner is supplied from a developing unit to an electrostatic latent image formed on the surface of a photoconductor drum, or the like, to perform a developing process. Toner used in such a developing process is supplied to the developing unit from a toner case.

For example, a toner case equipped with a toner container that contains toner and an intermediate hopper is known. The intermediate hopper is mounted between the toner container and the developing unit. The above-described intermediate hopper is typically provided with an agitating unit such as an agitating paddle and a transportation unit such as a transportation screw. The agitating unit agitates the toner and the transportation unit transports the toner. The intermediate hopper allows the toner transported from the toner container, to be transported to the developing unit using the transportation unit while the toner is agitated using the agitating unit. With the intermediate hopper having the above-described structure being located between the toner container and the developing unit, the toner can be supplied to the developing unit from the intermediate hopper even when the toner container runs out of toner. This allows the toner container to be replaced without a delay in the supply of toner to the developing unit.

In the related art intermediate hopper having the above-described structure, in order to meet the demands for a reduction in the size of the apparatus and the like, the agitating unit and the transportation unit are rotated using a single driving unit (for example, a motor). That is, when the agitating unit is rotated by the driving unit, the transportation unit is always simultaneously rotated along with the agitating unit.

In a toner case having the above-described structure, sometimes it is desirable that only an agitation of the toner contained in the intermediate hopper is performed. Such a situation occurs, for example, immediately after the mode of the image forming apparatus has been changed from a sleep mode to a normal mode, after the power has been turned on, after the toner container has been replaced, and the like. In addition, in order to quickly and correctly detect the remaining amount of the toner in the intermediate hopper, the toner contained in the intermediate hopper needs to be agitated even when toner is not being transported from the intermediate hopper to the developing unit. However, as described above, in the related art intermediate hopper, when the agitating unit is rotated, the transportation unit is always simultaneously rotated. Thus, operation of the intermediate hopper wherein the intermediate hopper agitates the toner without supplying the toner from the intermediate hopper to the developing unit cannot be performed.

SUMMARY

According to an embodiment of the present disclosure, a toner case is provided that includes a main body, that contains toner, a discharge port in the main body through which toner is discharged, an agitating unit rotatably provided in the main body that agitates the toner, a transportation unit rotatably provided in the main body that transports the toner toward the discharge port, and a driving unit that drives the transportation unit and the agitating unit. The driving unit is rotatable forward and backward. When the driving unit rotates in one rotation direction, the agitating unit and the transportation unit rotate. When the driving unit rotates in the other rotation direction, the transportation unit does not rotate and the agitating unit rotates in the same direction as the direction in which the agitating unit rotates when the driving unit rotates in the one rotation direction of the driving unit.

According to another embodiment of the present disclosure, an image forming apparatus is provided that includes an apparatus main body, the above-described toner case, and a developing unit.

According to yet another embodiment of the present disclosure, a method of driving a toner case is provided that drives a toner case. The toner case includes a main body that contains toner, a discharge port, provided in the main body, through which toner is discharged, an agitating unit rotatably provided in the main body that agitates the toner, a transportation unit rotatably provided in the main body that transports the toner toward the discharge port, and a driving unit that drives the transportation unit and the agitating unit. The method includes rotating the driving unit in one rotation direction of the driving unit so as to rotate the agitating unit and the transportation unit, and rotating the driving unit in the other rotation direction of the driving unit so as to rotate the agitating unit in the same direction as a direction in which the agitating unit rotates when the driving unit rotates in the one rotation direction of the driving unit and so as not to rotate the transportation unit.

Additional features and advantages are described herein, and will be apparent from the following Detailed Description and the figures.

DETAILED DESCRIPTION

Figure 1:
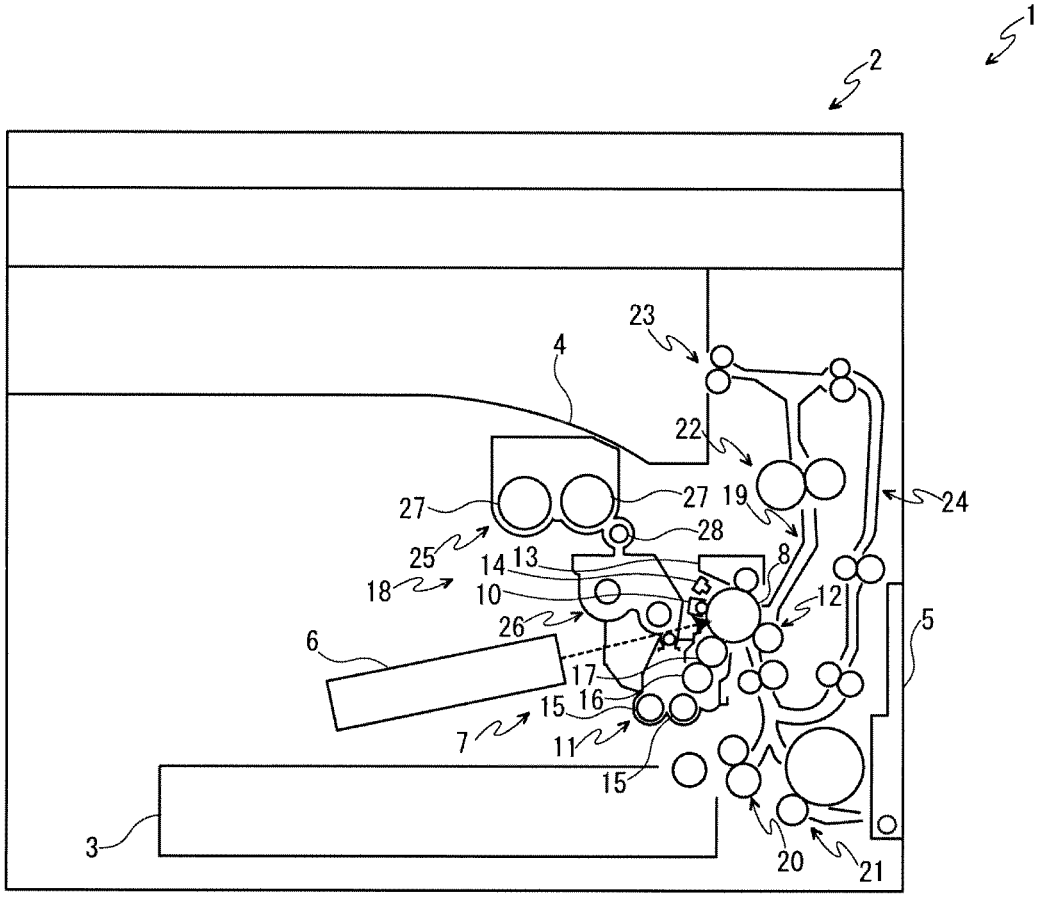
FIG. 1 is a schematic diagram illustrating an outline of the structure of a monochrome printer according to an embodiment of the present disclosure.

The general structure of a monochrome printer 1 is initially described with reference to FIG. 1. FIG. 1 is a schematic diagram illustrating an outline of the structure of a monochrome printer according to an embodiment of the present disclosure.

The monochrome printer 1 includes a box-shaped printer main body 2. A sheet feed cassette 3 is provided in a lower portion of the printer main body 2. Sheets of transfer paper (not shown) are loaded in the sheet feed cassette 3. A delivery tray 4 is provided at an upper end of the printer main body 2. A normally closed manual feed tray 5 is provided in a lower portion on one side surface (right side surface in FIG. 1) of the printer main body 2.

An exposure unit 6, which includes a laser scanning unit (LSU), is located in a lower central portion of the printer main body 2. An image forming unit 7 is located on one side (right side in FIG. 1) of the printer main body 2. A photoconductor drum 8 is rotatably provided in the image forming unit 7. A charger 10, a developing unit 11, a transfer unit 12, a cleaning device 13, and an eraser 14 are positioned around the photoconductor drum 8 in the order of transfer processes.

A pair of agitating rollers 15 is located in a lower portion of the developing unit 11. A magnetic roller 16 is located above the pair of the agitating rollers 15, and a developing roller 17 is located above the magnetic roller 16. A toner transportation device 18 is located above the developing unit 11. The details of the toner transportation device 18 will be described hereinafter.

A transportation path 19, through which a transfer sheet is transported, is formed on one side (right side in FIG. 1) of the printer main body 2. Along the transportation path 19, a sheet feed unit 20 and a manual sheet feed unit 21 are located at an upstream end, a fixing unit 22 is located in a downstream, and a sheet delivery port 23 is located at a downstream end. An inversion path 24 is formed at one end (right end in FIG. 1) of the printer main body 2.

Next, an image forming operation of the monochrome printer 1 having the above-described structure will be described.

When the power of the monochrome printer 1 is turned on, a variety of parameters are initialized, and initial settings such as a temperature setting of the fixing unit 22 are performed. When image data is inputted to the monochrome printer 1 from a computer or the like connected to the monochrome printer 1 and the monochrome printer 1 is instructed to start printing, the image forming operation is performed as follows.

A surface of the photoconductor drum 8 is initially charged by the charger 10. After that, the photoconductor drum 8 is exposed to laser light emitted from the exposure unit 6 corresponding to the image data, thereby forming an electrostatic latent image on the surface of the photoconductor drum 8. Next, the developing unit 11 develops the electrostatic latent image to a toner image with toner.

A transfer sheet picked up by the sheet feed unit 20, or the manual sheet feed unit 21 from the sheet feed cassette 3 or the manual feed tray 5, is fed to the transfer unit 12 at a timing that is adjusted with respect to the timing of the above-described image forming operation. The transfer unit 12 transfers the toner image on the photoconductor drum 8 onto the transfer sheet. The transfer sheet, onto which the toner image has been transferred, is fed through the transportation path 19 toward the downstream side, and enters the fixing unit 22. The fixing unit 22 fixes the toner image onto the transfer sheet. The transfer sheet, onto which the toner image has been fixed, is delivered to the delivery tray 4 from the sheet delivery port 23. Toner and electrical charges remaining on the photoconductor drum 8 are removed by the cleaning device 13 and the eraser 14.

Figure 2:
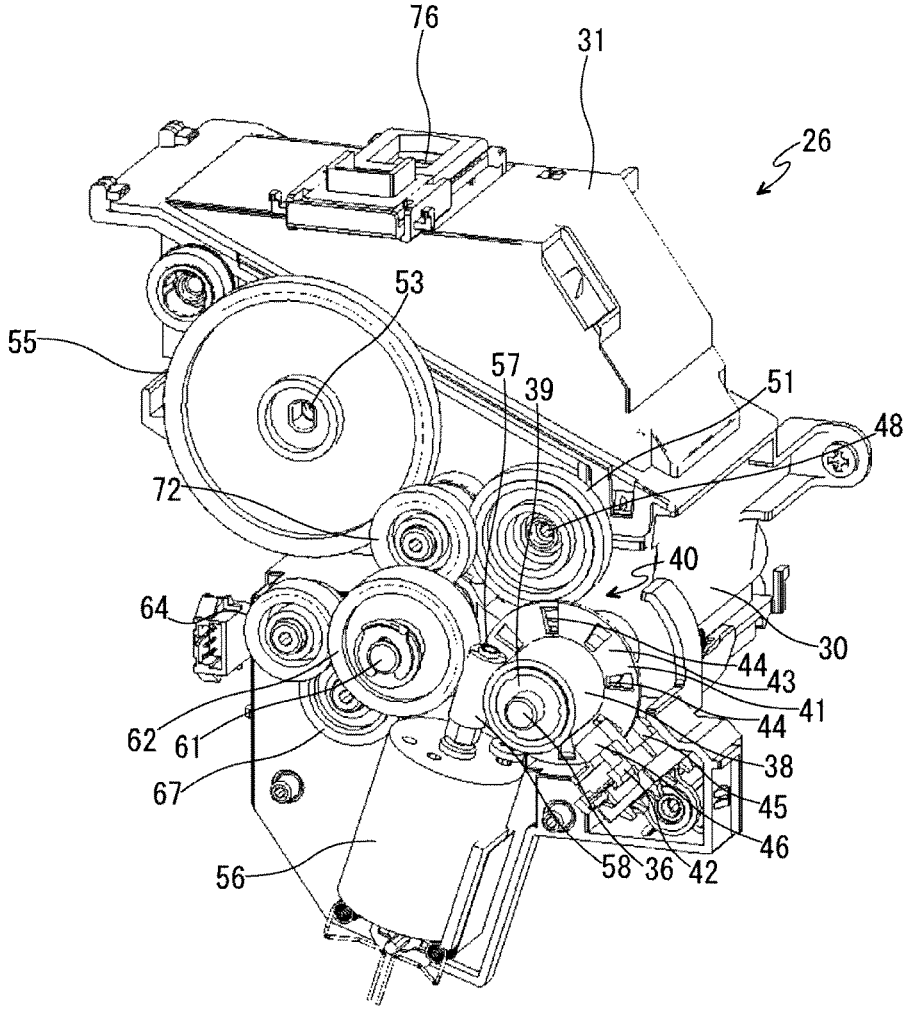
FIG. 2 is a front perspective view illustrating an intermediate hopper of the monochrome printer according to an embodiment of the present disclosure.
Figure 3:
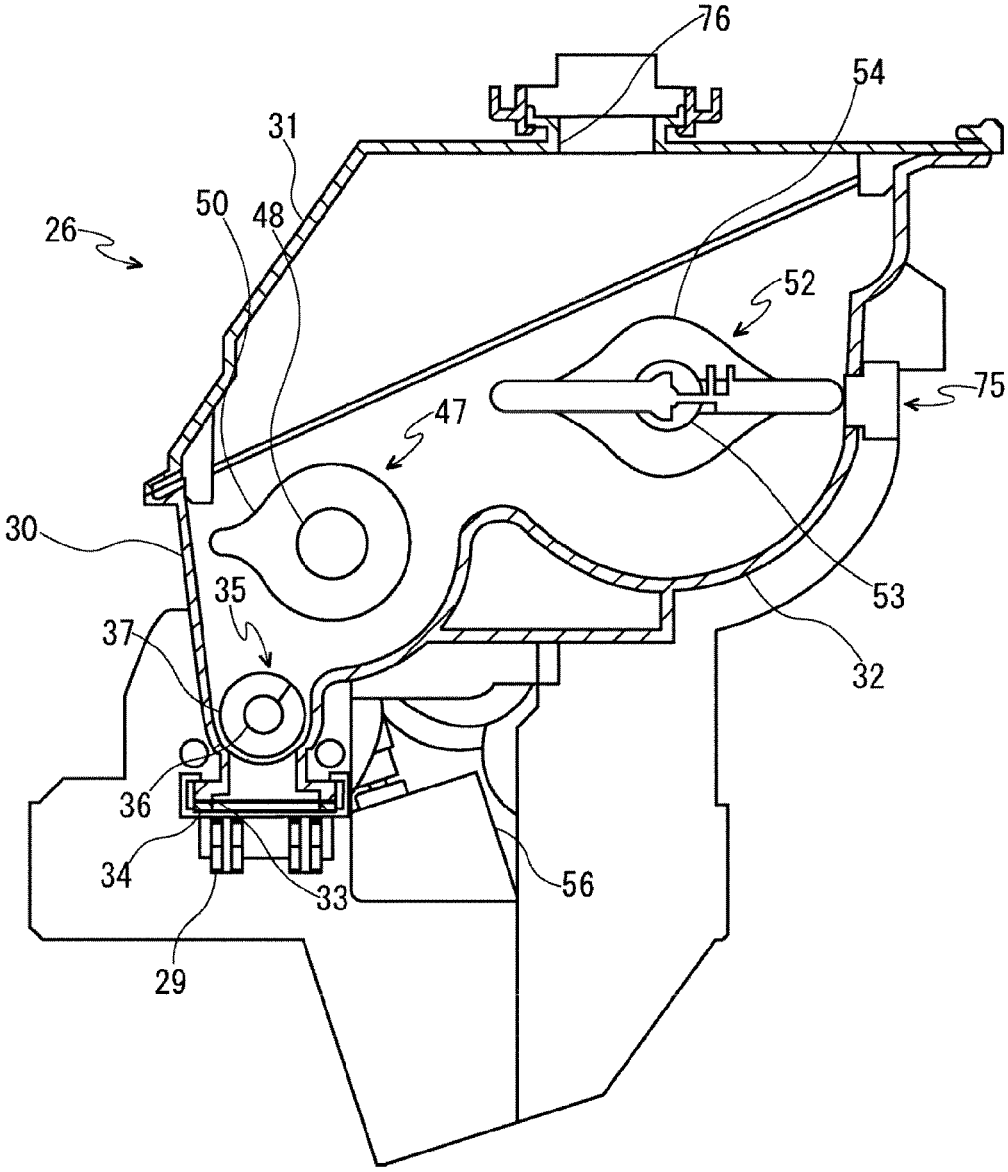
FIG. 3 is a rear side sectional view illustrating the intermediate hopper of the monochrome printer according to an embodiment of the present disclosure.
Figure 4:
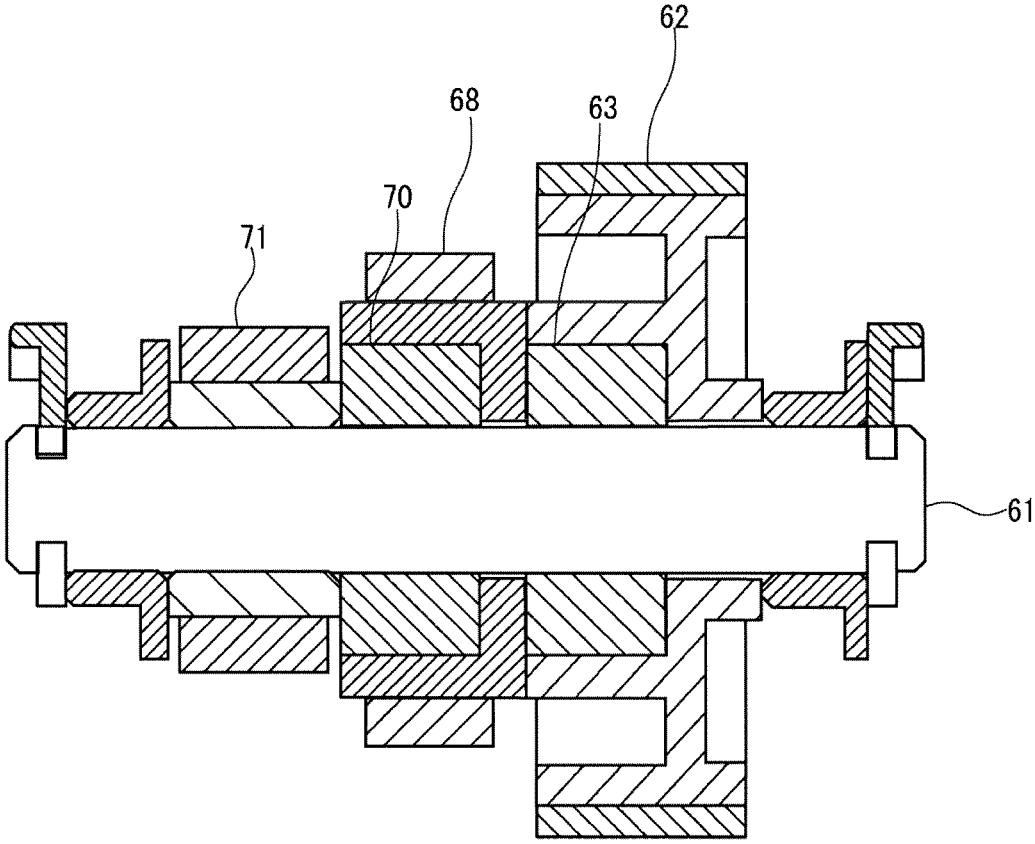
FIG. 4 is a sectional view illustrating the structure of gears provided on a transmission shaft in the intermediate hopper of the monochrome printer according to an embodiment of the present disclosure.
Figure 5:
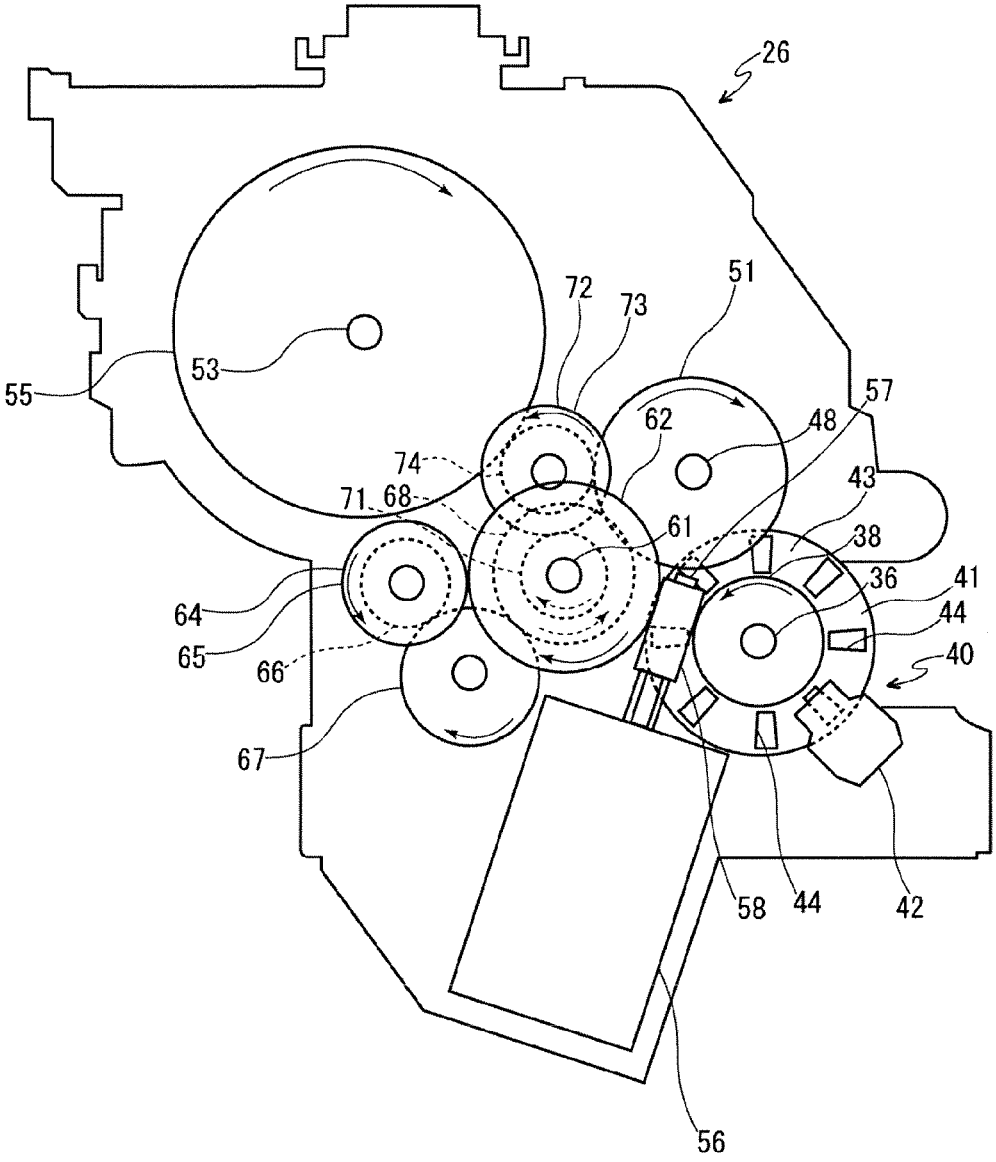
FIG. 5 is a schematic diagram illustrating rotation directions of gears of the intermediate hopper of the monochrome printer according to an embodiment of the present disclosure when the drive motor rotates in a forward rotation direction.
Figure 6:
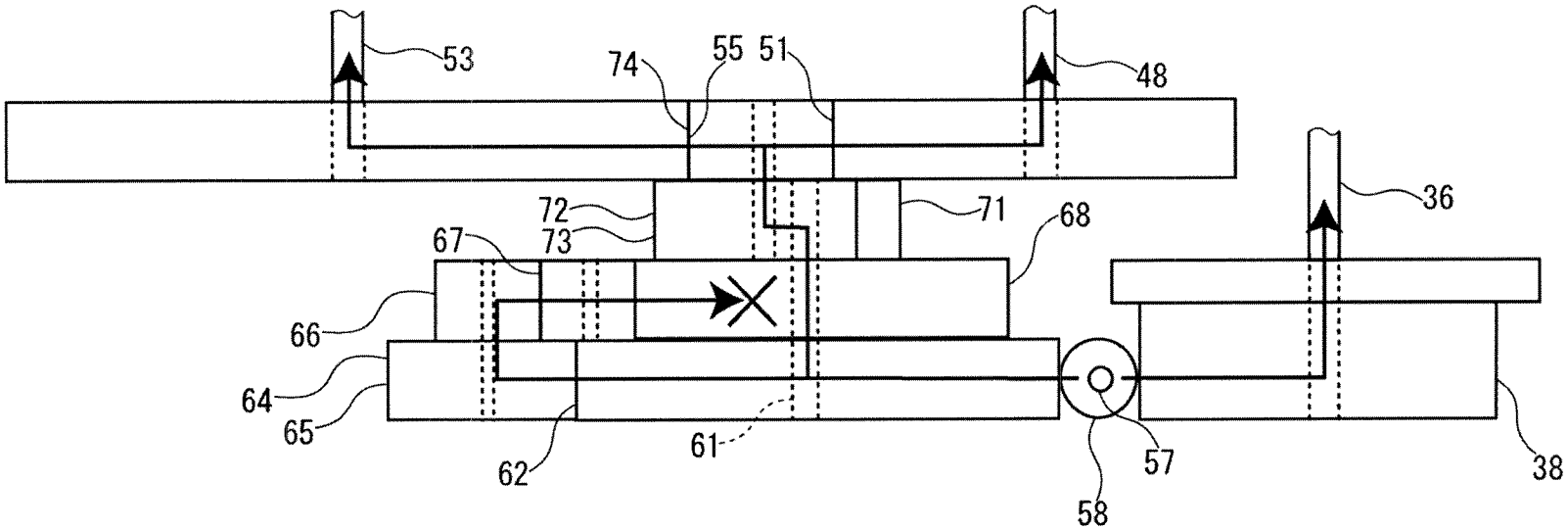
FIG. 6 is a schematic diagram illustrating torque transmission paths in the intermediate hopper of the monochrome printer according to an embodiment of the present disclosure when the drive motor rotates in the forward rotation direction.
Figure 7:
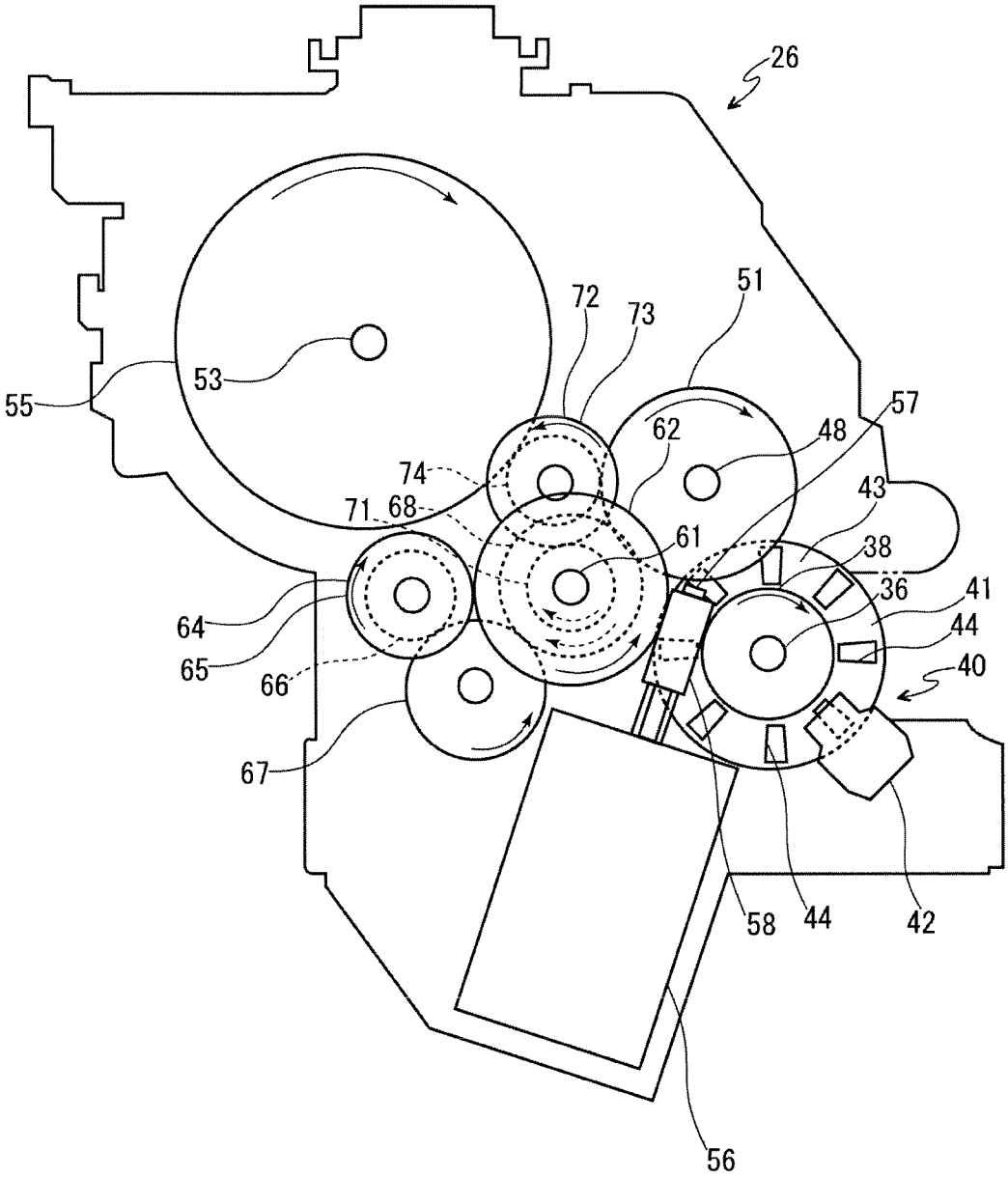
FIG. 7 is a schematic diagram illustrating the rotation directions of the gears in the intermediate hopper of the monochrome printer according to an embodiment of the present disclosure when the drive motor rotates in a backward rotation direction.
Figure 8:
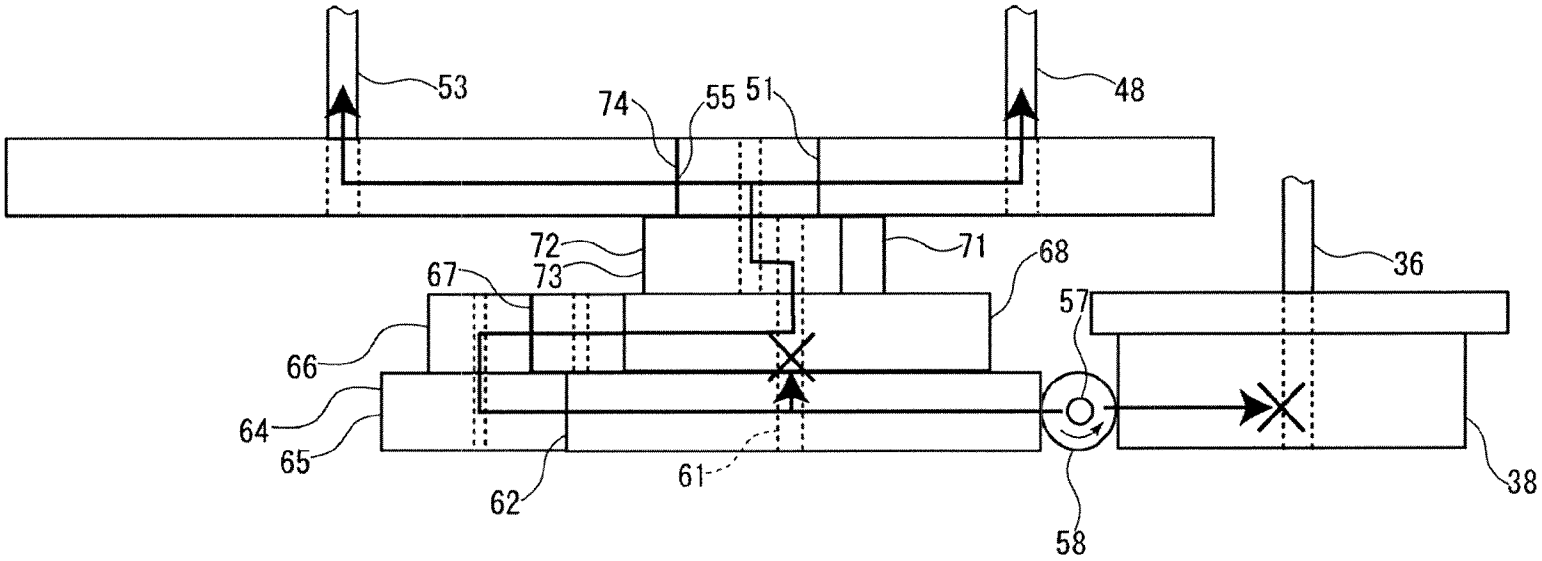
FIG. 8 is a schematic diagram illustrating the torque transmission paths in the intermediate hopper of the monochrome printer according to an embodiment of the present disclosure when the drive motor rotates in the backward rotation direction.

Next, the toner transportation device 18 will be described with reference to FIGS. 1 to 8. As described above, FIG. 1 is a schematic diagram illustrating the outline of the structure of the monochrome printer according to an embodiment of the present disclosure. FIG. 2 is a front perspective view illustrating an intermediate hopper of the monochrome printer according to an embodiment of the present disclosure. FIG. 3 is a rear side sectional view illustrating the intermediate hopper of the monochrome printer according to an embodiment of the present disclosure seen from a rear side. FIG. 4 is a sectional view illustrating the structure of gears provided on the transmission shaft in the intermediate hopper of the monochrome printer according to an embodiment of the present disclosure. FIG. 5 is a schematic diagram illustrating rotation directions of gears of the intermediate hopper of the monochrome printer according to an embodiment of the present disclosure when a drive motor rotates in a forward rotation direction. FIG. 6 is a schematic diagram illustrating torque transmission paths in the intermediate hopper of the monochrome printer according to an embodiment of the present disclosure when the drive motor rotates in the forward rotation direction. FIG. 7 is a schematic diagram illustrating the rotation directions of the gears in the intermediate hopper of the monochrome printer according to an embodiment of the present disclosure when the drive motor rotates in a backward direction. FIG. 8 is a schematic diagram illustrating torque transmission paths in the intermediate hopper of the monochrome printer according to an embodiment of the present disclosure when the drive motor rotates in the backward direction. For convenience of explanation, a front side in FIG. 1 is hereafter referred to as a front surface side of the toner transportation device 18.

As illustrated in FIG. 1, the toner transportation device 18 includes an intermediate hopper 26 serving as a toner case and a toner container 25 serving as another toner case. The toner container 25 is provided in an upper portion of the printer main body 2. The intermediate hopper 26 is located between the toner container 25 and the developing unit 11.

The toner container 25 contains toner. The toner container 25 is removably mounted in a toner container mounting unit (not shown) provided in the printer main body 2. The toner container 25 is replaceable when the toner container 25 has run out of the toner.

A pair of left and right agitating members 27 are rotatably positioned in a lower portion of the toner container 25. A transportation member 28 is rotatably provided at a position below the right agitating member 27 on the right hand side. The transportation member 28 and each of the agitating members 27 are connected to the container drive motor (not shown) provided in a container drive section (not shown). The container drive section is removably mounted to the toner container 25. When the agitating members 27 and the transportation member 28 are rotated by the container drive motor, the toner in the toner container 25 is supplied to the intermediate hopper 26 while the toner is being agitated.

As illustrated in FIGS. 2 and 3, the intermediate hopper 26 includes a main body 30 and a lid body 31. An upper side of the main body 30 is open. The lid body 31 covers the upper side of the main body 30.

The main body 30 has a discharge port 33 (see FIG. 3) formed at a right end portion of a base wall 32 thereof. The interior of the main body 30 is connected to the interior of the developing unit 11 through the discharge port 33. The discharge port 33 is closed by a shutter 29 when the intermediate hopper 26 is not mounted to the developing unit 11. Mounting the intermediate hopper 26 to the developing unit 11 causes the shutter 29 to slide, thereby opening the discharge port 33. In this embodiment, the above-described sliding shutter 29 is used. In another embodiment, a rotating shutter may be used. In this situation, mounting the developing unit 11 in the printer main body 2 unlocks a lever. Then, by operation of the lever a user can cause the shutter to rotate, thereby opening the discharge port 33. A toner seal 34 is bonded to an area around the discharge port 33 on a lower surface of the base wall 32 of the main body 30.

In the main body 30, a transportation screw 35, which serves as a transportation unit, is rotatably mounted above the discharge port 33. The transportation screw 35 includes a rotation shaft 36, a spiral fin 37, and a transportation gear 38 (see FIG. 2 and so forth). The rotation shaft 36 is rotatably supported by the main body 30. The spiral fin 37 is concentrically provided in the outer periphery of the rotation shaft 36. The transportation gear 38 is provided at a front end of the rotation shaft 36.

A transportation one-way clutch 39 is positioned between the transportation gear 38 and the rotation shaft 36 of the transportation screw 35. The transportation one-way clutch 39 can be formed using a one-way clutch structure such as a ratchet one-way clutch or a roller one-way clutch. The transportation one-way clutch 39 causes the rotation shaft 36, of the transportation screw 35, to rotate together with the transportation gear 38 when the transportation gear 38 rotates in one rotation direction of the transportation gear 38 (counterclockwise in front view in the present embodiment). The transportation one-way clutch 39 causes the transportation gear 38 to idle with respect to the rotation shaft 36 of the transportation screw 35 when the transportation gear 38 rotates in the other rotation direction of the transportation gear 38 (clockwise in front view in the present embodiment).

As most clearly illustrated in FIG. 2, a detection unit 40 is positioned in a front portion of the rotation shaft 36 of the transportation screw 35. The detection unit 40 includes a pulse plate 41 and a sensor 42. The pulse plate 41 is integrally formed with the transportation gear 38 at a position behind the transportation gear 38. The sensor 42 is secured to the main body 30 at a position below the pulse plate 41 on the right hand side. A light shielding portion 43 is provided in an outer diameter area of the pulse plate 41. The light shielding portion 43 has eight slits 44 equally spaced in a peripheral direction thereof.

The sensor 42 is a photo interrupter sensor (a PI sensor) and includes a light emitter 45 and a light receiver 46. The light emitter 45 is positioned behind the light shielding portion 43 in a width direction of the pulse plate 41. The light receiver 46 is positioned in front of the light shielding portion 43 in the width direction of the pulse plate 41. The light emitter 45 and the light receiver 46 oppose each other and are located on one side and the other side of the light shielding portion 43. When the pulse plate 41 rotates, a detection light path from the light emitter 45 to the light receiver 46 is continuously alternatingly formed and interrupted by the slits 44 and the light shielding portion 43. By counting formation and interruption cycles, the number of rotations of the pulse plate 41 can be detected. Since the pulse plate 41 rotates together with the rotation shaft 36 of the transportation screw 35, the number of rotations of the transportation screw 35 can be detected by detecting the number of rotations of the pulse plate 41. The detection result is used to estimate the remaining amount of the toner in the intermediate hopper 26. In an embodiment, since the pulse plate 41 has eight slits 44, the sensor 42 detects 8 pulses during one rotation of the transportation screw 35 and the pulse plate 41. The sensor 42 is connected to a control unit (not shown), and can output a rotation number detection signal of the transportation screw 35 to the control unit.

In the main body 30, a first agitating paddle 47 (see FIG. 3), which serves as an agitating unit, is rotatably provided above the transportation screw 35 on the left hand side. The first agitating paddle 47 has a rotation shaft 48, which is rotatably supported by the main body 30. Agitating blades 50 are secured to an outer periphery of the rotation shaft 48. Each agitating blade 50 is formed of a flexible film such as, for example, a polyethylene terephthalate (PET) film or a polyester film. A first agitating gear 51 (see FIG. 2 and so forth) is located at a front end of the rotation shaft 48 of the first agitating paddle 47.

A second agitating paddle 52, which serves as another agitating unit, is rotatably located on the left hand side of the first agitating paddle 47. The second agitating paddle 52 is located with a rotation shaft 53, which is rotatably supported by the main body 30. Agitating blades 54 are secured to an outer periphery of the rotation shaft 53. Each agitating blade 54 is formed of a flexible film such as, for example, a PET film or a polyester film. A second agitating gear 55 (see FIG. 2 and so forth) is located at a front end of the rotation shaft 53 of the second agitating paddle 52.

As most clearly illustrated in FIG. 2, a drive motor 56, which serves as a driving unit, is mounted in a front lower portion of the main body 30 so as to be inclined rightward from the lower to upper portions thereof. The drive motor 56 is a direct-current (DC) brush motor. In another embodiment, as the drive motor 56, any motor such as a DC brushless motor or a stepping motor instead of a DC brush motor may be used. The drive motor 56 is connected to the control unit (not shown) through a motor drive unit (not shown). A signal from the control unit causes a current to flow from the motor drive unit to the drive motor 56.

The drive motor 56 includes a motor shaft 57 that is inclined rightward from the lower to upper portions thereof. A worm 58 is secured to the motor shaft 57. A right side of the worm 58 is engaged with the transportation gear 38. Thus, the motor shaft 57 is connected to the rotation shaft 36 of the transportation screw 35 through the worm 58, the transportation gear 38, and the transportation one-way clutch 39.

The motor shaft 57 of the drive motor 56 is also connected to the rotation shaft 48 of the first agitating paddle 47 and the rotation shaft 53 of the second agitating paddle 52. These connections are described as follows. A transmission shaft 61 is positioned on the left hand side of the worm 58 located on the motor shaft 57. A first transmission gear 62, which is located at a front end portion of the transmission shaft 61, is engaged with the worm 58.

As illustrated in FIG. 4, a first one-way clutch 63 is located between the first transmission gear 62 and the transmission shaft 61. The first one-way clutch 63 can be formed using a one-way clutch structure such as a ratchet one-way clutch or a roller one-way clutch. The first one-way clutch 63 causes the transmission shaft 61 to rotate together with the first transmission gear 62 when the first transmission gear 62 rotates in one rotation direction of the first transmission gear 62 (clockwise in front view in the present embodiment). The first one-way clutch 63 causes the first transmission gear 62 to idle with respect to the transmission shaft 61 when the first transmission gear 62 rotates in the other rotation direction of the first transmission gear 62 (counterclockwise in front view in an embodiment).

As illustrated in FIG. 5 and so forth, the first transmission gear 62 is engaged with a large diameter portion 65 of a first idle gear 64 located on the left hand side of the first transmission gear 62. A small diameter portion 66 of the first idle gear 64 is engaged with a second idle gear 67 located below the first idle gear 64 on the right hand side. The second idle gear 67 is engaged with a second transmission gear 68, which is located on the transmission shaft 61 behind the first transmission gear 62.

As illustrated in FIG. 4, a second one-way clutch 70 is positioned between the second transmission gear 68 and the transmission shaft 61. The second one-way clutch 70 can be formed using a one-way clutch structure such as a ratchet one-way clutch or a roller one-way clutch. The second one-way clutch 70 causes the transmission shaft 61 to rotate together with the second transmission gear 68 when the second transmission gear 68 rotates in one rotation direction of the second transmission gear 68 (clockwise in front view in an embodiment). The second one-way clutch 70 causes the second transmission gear 68 to idle with respect to the transmission shaft 61 when the second transmission gear 68 rotates in the other rotation direction of the second transmission gear 68 (counterclockwise in front view in an embodiment).

As illustrated in FIG. 5 and so forth, a third transmission gear 71, which is rotatable together with the transmission shaft 61, is located behind the second transmission gear 68. The third transmission gear 71 is engaged with a large diameter portion 73 of a third idle gear 72 located above the third transmission gear 71. A right side of a small diameter portion 74 of the third idle gear 72 is engaged with the first agitating gear 51 located on the rotation shaft 48 of the first agitating paddle 47. The left side of the small diameter portion 74 of the third idle gear 72 is engaged with the second agitating gear 55 located on the rotation shaft 53 of the second agitating paddle 52.

With the above-described structure, the motor shaft 57 of the drive motor 56 is connected to the rotation shaft 48 of the first agitating paddle 47 and the rotation shaft 53 of the second agitating paddle 52. In an embodiment, the speed reduction ratio of the transportation screw 35 and the second agitating paddle 52 is set to 1/9. Accordingly, when the second agitating paddle 52 performs one rotation, the transportation screw 35 performs nine rotations. That is, while the second agitating paddle 52 performs one rotation, the sensor 42 of the detection unit 40 detects 72 pulses, calculated by multiplying 8 pulses (number of pulses generated during one rotation of the transportation screw 35) by 9.

As illustrated in FIG. 3, a toner amount detection sensor 75 is located in the main body 30 on the left hand side of the second agitating paddle 52. In an embodiment, the toner amount detection sensor 75 comprises a piezoelectric sensor equipped with a piezoelectric element. In another embodiment, the toner amount detection sensor 75 may be structured by a sensor different from the piezoelectric sensor such as, for example, an optical sensor or a magnetic permeability sensor. The toner amount detection sensor 75 is connected to the control unit (not shown) and turned on or off in accordance with the amount of toner in the intermediate hopper 26.

The lid body 31, which covers the upper side of the main body 30 as described above, is secured to the main body 30 using ultrasonic welding. An introduction port 76 is provided in the lid body 31 near a central area of the lid body 31 in a left-right direction. Toner transported from the toner container 25 is introduced into the intermediate hopper 26 through the introduction port 76.

With the above-described structure, a case from which the toner is supplied from the intermediate hopper 26 to the developing unit 11 while the toner in the intermediate hopper 26 is being agitated during, for example, a normal printing operation will be described with reference to FIGS. 5 and 6. In FIG. 6, bold arrows indicate directions in which rotation of the drive motor 56 is transmitted.

The control unit initially transmits a drive instruction signal (forward rotation direction) to the motor drive unit to cause the motor shaft 57 of the drive motor 56 to rotate in a forward rotation direction (counterclockwise rotation in the present embodiment). The rotation of the motor shaft 57 is transmitted to the transportation gear 38 through the worm 58, thereby rotating the transportation gear 38 counterclockwise. Due to this counterclockwise rotation of the transportation gear 38, the transportation one-way clutch 39 causes the rotation shaft 36 of the transportation screw 35 to rotate together with the transportation gear 38, thereby rotating the transportation screw 35 counterclockwise. Thus, the toner in the intermediate hopper 26 is transported to the developing unit 11.

When the motor shaft 57 of the drive motor 56 rotates in the forward rotation direction as described above, rotation is transmitted to the first transmission gear 62 through the worm 58, thereby rotating the first transmission gear 62 clockwise. Due to this clockwise rotation of the first transmission gear 62, the first one-way clutch 63 causes the transmission shaft 61 to rotate together with the first transmission gear 62. Thus, the transmission shaft 61 and the third transmission gear 71 rotate clockwise. The large diameter portion 73 of the third idle gear 72, which is engaged with the third transmission gear 71, rotates counterclockwise, thereby rotating clockwise the first agitating gear 51 and the second agitating gear 55, which are engaged with the small diameter portion 74 of the third idle gear 72. Accordingly, the first agitating paddle 47 and the second agitating paddle 52 are each also rotated clockwise. Thus, the toner in the intermediate hopper 26 is transported toward the transportation screw 35 while the toner in the intermediate hopper 26 is agitated.

As described above, when the first transmission gear 62 rotates clockwise, the first idle gear 64 rotates counterclockwise, the second idle gear 67 rotates clockwise, and the second transmission gear 68 rotates counterclockwise. When the second transmission gear 68 rotates counterclockwise as described above, the second one-way clutch 70 causes the second transmission gear 68 to idle with respect to the transmission shaft 61. Accordingly, rotation is not transmitted from the second transmission gear 68 to the transmission shaft 61.

Next, the situation wherein the toner in the intermediate hopper 26 is agitated without supplying toner, for example, from the intermediate hopper 26 to the developing unit 11 will be described with reference to FIGS. 7 and 8. In FIG. 8, bold arrows indicate the directions in which rotation of the drive motor 56 is transmitted.

The control unit initially transmits a drive instruction signal (backward rotation direction) to the motor drive unit to cause the motor shaft 57 of the drive motor 56 to rotate in a backward rotation direction (clockwise direction in the present embodiment). The rotation of the motor shaft 57 is transmitted to the transportation gear 38 through the worm 58, thereby rotating the transportation gear 38 clockwise. When the transportation gear 38 rotates clockwise as described above, the transportation one-way clutch 39 causes the transportation gear 38 to idle with respect to the rotation shaft 36 of the transportation screw 35, thereby not transmitting rotation from the transportation gear 38 to the transportation screw 35. Accordingly, the transportation screw 35 does not rotate and toner is not supplied from the intermediate hopper 26 to the developing unit 11.

When the motor shaft 57 of the drive motor 56 rotates in a backward rotation direction as described above, the rotation is transmitted to the first transmission gear 62 through the worm 58, thereby rotating the first transmission gear 62 counterclockwise. When the first transmission gear 62 rotates counterclockwise as described above, the first one-way clutch 63 causes the first transmission gear 62 to idle with respect to the transmission shaft 61. Accordingly, rotation is not transmitted from the first transmission gear 62 to the transmission shaft 61.

When the first transmission gear 62 rotates counterclockwise as described above, the first idle gear 64 rotates clockwise, the second idle gear 67 rotates counterclockwise, and the second transmission gear 68 rotates clockwise. Due to this clockwise rotation of the second transmission gear 68, the second one-way clutch 70 causes the transmission shaft 61 to rotate together with the second transmission gear 68. That is, the transmission shaft 61 and the third transmission gear 71 rotate clockwise. The large diameter portion 73 of the third idle gear 72, which is engaged with the third transmission gear 71, rotates counterclockwise, thereby rotating the first agitating gear 51 and the second agitating gear 55 clockwise. Accordingly, the first agitating paddle 47 and the second agitating paddle 52 are each rotated clockwise, thereby agitating the toner in the intermediate hopper 26.

The above-described agitation of the toner, without supplying the toner from the intermediate hopper 26 to the developing unit 11, is performed in order to make the surface of the toner in the intermediate hopper 26 level when the monochrome printer 1 is initialized wherein, for example, after the mode of the monochrome printer 1 has been changed from a sleep mode to a normal mode, after power is turned on, and the like. In this situation, the agitation may be continued until the detection unit 40 detects the specified number of pulses. Assume that agitation is performed by rotating the second agitating paddle 52, for example, ten times. In this situation, as described above, since the number of pulses corresponding to one rotation of the second agitating paddle 52 is 72, the agitation may be controlled so as to be continued until the accumulated number of times the rotation number detection signal has been output from the detection unit 40 to the control unit reaches 720 pulses, which is calculated by multiplying 72 pulses by 10.

The above-described agitation of the, toner without supplying the toner from the intermediate hopper 26 to the developing unit 11 is performed in order to make the surface of the toner in the intermediate hopper 26 level while the intermediate hopper 26 is being supplied the toner wherein, for example, the toner container 25 has been replaced. In this situation, agitation of the toner may be continued, for example, until the supply of the toner from the toner container 25 to the intermediate hopper 26 is stopped due to switching of the state of a toner amount detection signal, which is outputted from the toner amount detection sensor 75 to the control unit, from low to high when the intermediate hopper 26 is completely filled with toner.

In an embodiment, as described above, when the drive motor 56 rotates in the forward rotation direction, the transportation screw 35 rotates. When the drive motor 56 rotates in the backward rotation direction, the transportation screw 35 stops. This allows the monochrome printer 1 to operate in the following two cases: when it is desirable that the toner in the intermediate hopper 26 be agitated while the toner is supplied from the intermediate hopper 26 to the developing unit 11, and when it is desirable that the toner in the intermediate hopper 26 be agitated while toner is not supplied from the intermediate hopper 26 to the developing unit 11. In addition, even when the toner is not transported from the intermediate hopper 26 to the developing unit 11, the toner in the intermediate hopper 26 can be agitated. This can reduce compaction of the toner. Thus, the toner can always be smoothly transported. This allows the remaining amount of the toner in the intermediate hopper 26 to be quickly and correctly detected.

When the drive motor 56 rotates in the backward rotation direction, the first and second agitating paddles 47 and 52 each rotate in the same direction as the direction in which the first and second agitating paddles 47 and 52 rotate when the drive motor 56 rotates in the forward rotation direction. With this structure, regardless of whether the drive motor 56 rotates in the forward or backward rotation direction, toner can be reliably transported toward the transportation screw 35 using the first and second agitating paddles 47 and 52. This can improve efficiency of toner transportation. The first and second agitating paddles 47 and 52 rotate in the same direction when the drive motor 56 rotates in the forward rotation direction and when the drive motor 56 rotates in the backward rotation direction. Thus, leveling the surface of the toner in the intermediate hopper 26 using the first and second agitating paddles 47 and 52 can be increased.

In an embodiment, the intermediate hopper is supplied toner from the toner container. With the above-described structure being used, the intermediate hopper can be supplied toner from the toner container while toner in the intermediate hopper can be agitated without supplying toner to the developing unit.

Figure 9:
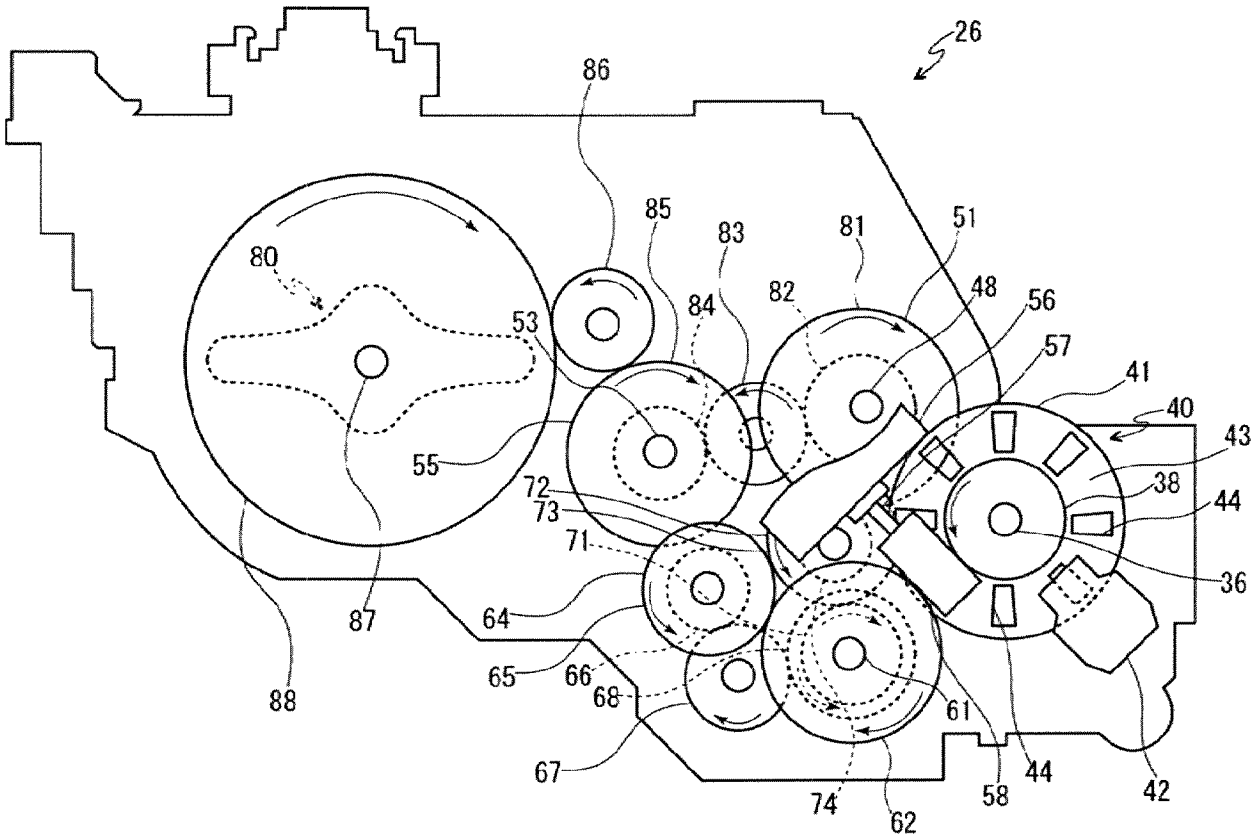
FIG. 9 is a schematic diagram of an intermediate hopper according to another embodiment.

In an embodiment, as described above, the agitating paddles include the first agitating paddle 47 and the second agitating paddle 52. In another embodiment, when the intermediate hopper 26 having a width greater than that of the previous embodiment is used, the agitating paddles may include a third agitating paddle 80 in addition to the first and second agitating paddles 47 and 52 as illustrated in FIG. 9. In this situation, the following structure may be used. Specifically, the small diameter portion 74 of the third idle gear 72 is engaged with the large diameter portion 81 of the first agitating gear 51. A small diameter portion 82 of the first agitating gear 51 is engaged with a small diameter portion 84 of the second agitating gear 55 via a fourth idle gear 83. A large diameter portion 85 of the second agitating gear 55 is engaged with a third agitating gear 88 provided on a rotation shaft 87 of the third agitating paddle 80 via a fifth idle gear 86. With the above-described structure being used, the first to third agitating paddles 47, 52, and 80 can rotate in the same direction. As described above, the number and arrangement of the agitating paddles may be changed where appropriate in accordance with the size and shape of the intermediate hopper 26.

In an embodiment, the drive motor 56 is disposed so as to be inclined rightward from the lower to upper positions thereof. In yet another embodiment, as illustrated in FIG. 9, the drive motor 56 may be positioned so as to be inclined rightward from the upper to lower portions thereof. In yet another embodiment, the drive motor 56 can assume a horizontal or vertical position. As described above, the position which the drive motor 56 assumes can be changed where appropriate in accordance with the size and shape of the intermediate hopper 26.

In an embodiment, a rotational direction of the drive motor 56 is a direction in which the motor shaft 57 of the drive motor 56 rotates in the forward rotation direction (counterclockwise rotation). Alternatively, the rotation direction of the drive motor 56 may be the direction in which the drive motor 56 rotates in the backward rotation direction (clockwise rotation).

In an embodiment, the rotation direction of the transportation gear 38 is the direction in which the transportation gear 38 rotates counterclockwise, as viewed from the front view, and the other rotation direction of the transportation gear 38 is the direction in which the transportation gear 38 rotates clockwise. In yet another embodiment, the rotation direction of the transportation gear 38 may be a direction in which the transportation gear 38 rotates clockwise, when viewed from the front, and the other rotation direction of the transportation gear 38 may be the direction in which the transportation gear 38 rotates counterclockwise.

In an embodiment, the rotation direction of each of the first and second agitating gears 51 and 55 is the direction in which each of the first and second agitating gears 51 and 55 rotates clockwise, when viewed from the front, and the other rotation direction of each of the first and second agitating gears 51 and 55 is the direction in which each of the first and second agitating gears 51 and 55 rotates counterclockwise. In yet another embodiment, the rotation direction of each of the first and second agitating gears 51 and 55 may be a direction in which each of the first and second agitating gears 51 and 55 rotates counterclockwise, when viewed from the front, and the other rotation direction of each of the first and second agitating gears 51 and 55 may be a direction in which each of the first and second agitating gears 51 and 55 rotates clockwise.

Although in an embodiment, each agitating unit is defined by a corresponding one of the agitating paddles, the agitating unit may be defined by a screw-shaped member in yet another embodiment.

In an embodiment, the present disclosure is applied to the monochrome printer 1. In other embodiments, the present disclosure may be applied to color printers, copying machines, digital multi-function peripherals, facsimile machines, and other image forming apparatuses.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A toner case comprising:

a main body that contains toner;

a discharge port located in the main body through which toner is discharged;

an agitating unit rotatably positioned in the main body that agitates the toner;

a transportation unit rotatably positioned in the main body for transporting toner toward the discharge port;

a driving unit that drives the transportation unit and the agitating unit;

a first transmission gear provided on a transmission shaft so as to allow the first transmission gear to rotate as the driving unit rotates;

a first one-way clutch that causes the transmission shaft to rotate together with the first transmission gear when the first transmission gear rotates in one rotation direction of the first transmission gear, and causes the first transmission gear to idle with respect to the transmission shaft when the first transmission gear rotates in the other rotation direction of the first transmission gear;

a first idle gear engaged with the first transmission gear;

a second idle gear engaged with the first idle gear;

a second transmission gear provided on the transmission shaft, the second transmission gear being engaged with the second idle gear;

a second one-way clutch that causes the transmission shaft to rotate together with the second transmission gear when the second transmission gear rotates in one rotation direction of the second transmission gear, and causes the second transmission gear to idle with respect to the transmission shaft when the second transmission gear rotates in the other rotation direction of the second transmission gear; and a third transmission gear provided so as to be rotatable together with the transmission shaft, wherein the agitating unit rotates as the third transmission gear rotates, the driving unit is rotatable forward and backward, when the driving unit rotates in one rotation direction of the driving unit, the agitating unit and the transportation unit rotate, and when the driving unit rotates in the other rotation direction of the driving unit, the transportation unit does not rotate and the agitating unit rotates in the same direction as a direction in which the agitating unit rotates when the driving unit rotates in the one rotation direction of the driving unit.

2. The toner case according to claim 1, wherein a plurality of the agitating units are provided in the main body, and the plurality of agitating units rotate as the third transmission gear rotates.

3. The toner case according to claim 1, comprising:

a transportation gear provided on a rotation shaft of the transportation unit; and a transportation one-way clutch that causes the rotation shaft of the transportation unit to rotate together with the transportation gear when the transportation gear rotates in one rotation direction of the transportation gear, and causes the transportation gear to idle with respect to the rotation shaft of the transportation unit when the transportation gear rotates in the other rotation direction of the transportation gear.

4. The toner case according to claim 1, wherein the main body is supplied toner from another toner case.

5. The toner case according to claim 1, wherein the driving unit includes a motor provided with a motor shaft, the one rotation direction of the driving unit is a direction in which the driving unit rotates when the motor shaft rotates counterclockwise when viewed from the front, and the other rotation direction of the driving unit is a direction in which the driving unit rotates when the motor shaft rotates clockwise when viewed from the front.

6. The toner case according to claim 1, wherein the driving unit includes a motor provided with a motor shaft, the one rotation direction of the driving unit is a direction in which the driving unit rotates when the motor shaft rotates clockwise when viewed from the front, and the other rotation direction of the driving unit is a direction in which the driving unit rotates when the motor shaft rotates counterclockwise when viewed from the front.

7. An image forming apparatus comprising:

an apparatus main body;

a toner case that includes a main body that contains toner, a discharge port located in the main body through which toner is discharged, an agitating unit rotatably positioned in the main body that agitates the toner, a transportation unit rotatably positioned in the main body for transporting toner toward the discharge port, a driving unit that drives the transportation unit and the agitating unit, a first transmission gear provided on a transmission shaft so as to allow the first transmission gear to rotate as the driving unit rotates, a first one-way clutch that causes the transmission shaft to rotate together with the first transmission gear when the first transmission gear rotates in one rotation direction of the first transmission gear, and causes the first transmission gear to idle with respect to the transmission shaft when the first transmission gear rotates in the other rotation direction of the first transmission gear, a first idle gear engaged with the first transmission gear, a second idle gear engaged with the first idle gear, a second transmission gear provided on the transmission shaft, the second transmission gear being engaged with the second idle gear, a second one-way clutch that causes the transmission shaft to rotate together with the second transmission gear when the second transmission gear rotates in one rotation direction of the second transmission gear, and causes the second transmission gear to idle with respect to the transmission shaft when the second transmission gear rotates in the other rotation direction of the second transmission gear, and a third transmission gear provided so as to be rotatable together with the transmission shaft; and a developing unit to which the toner is supplied through the discharge port of the toner case, wherein the agitating unit rotates as the third transmission gear rotates, the driving unit is rotatable forward and backward, when the driving unit rotates in one rotation direction of the driving unit, the agitating unit and the transportation unit rotate, and when the driving unit rotates in the other rotation direction of the driving unit, the transportation unit does not rotate and the agitating unit rotates in the same direction as a direction in which the agitating unit rotates when the driving unit rotates in the one rotation direction of the driving unit.

8. The image forming apparatus according to claim 7, wherein a plurality of the agitating units are provided in the main body, and the plurality of agitating units rotate as the third transmission gear rotates.

9. The image forming apparatus according to claim 7, wherein the toner case further includes a transportation gear provided on a rotation shaft of the transportation unit, and a transportation one-way clutch that causes the rotation shaft of the transportation unit to rotate together with the transportation gear when the transportation gear rotates in one rotation direction of the transportation gear, and causes the transportation gear to idle with respect to the rotation shaft of the transportation unit when the transportation gear rotates in the other rotation direction of the transportation gear.

10. The image forming apparatus according to claim 7, wherein the driving unit includes a motor provided with a motor shaft, the one rotation direction of the driving unit is a direction in which the driving unit rotates when the motor shaft rotates counterclockwise when viewed from the front, and the other rotation direction of the driving unit is a direction in which the driving unit rotates when the motor shaft rotates clockwise when viewed from the front.

11. The image forming apparatus according to claim 7, wherein the driving unit includes a motor provided with a motor shaft, the one rotation direction of the driving unit is a direction in which the driving unit rotates when the motor shaft rotates clockwise when viewed from the front, and the other rotation direction of the driving unit is a direction in which the driving unit rotates when the motor shaft rotates counterclockwise when viewed from the front.

12. An image forming apparatus comprising:

an apparatus main body;

a toner case that includes a main body that contains toner, a discharge port located in the main body through which toner is discharged, an agitating unit rotatably positioned in the main body that agitates the toner, a transportation unit rotatably positioned in the main body for transporting toner toward the discharge port, and a driving unit that drives the transportation unit and the agitating unit; and a developing unit to which the toner is supplied through the discharge port of the toner case, wherein the driving unit is rotatable forward and backward, when the driving unit rotates in one rotation direction of the driving unit, the agitating unit and the transportation unit rotate, when the driving unit rotates in the other rotation direction of the driving unit, the transportation unit does not rotate and the agitating unit rotates in the same direction as a direction in which the agitating unit rotates when the driving unit rotates in the one rotation direction of the driving unit, and wherein the main body is supplied toner from another toner case.

13. The image forming apparatus according to claim 12, wherein the other toner case includes a toner container removably mounted in the apparatus main body, and the toner case includes an intermediate hopper mounted between the toner container and the developing unit.

14. The image forming apparatus according to claim 13, wherein the driving unit rotates in the other rotation direction of the driving unit when the image forming apparatus is initialized.

15. The image forming apparatus according to claim 13, wherein, immediately after the toner container is mounted, the driving unit continues to rotate in the other rotation direction of the driving unit until the intermediate hopper is completely filled up with the toner.

* * * * *